US006591774B2

(12) United States Patent
Metherell et al.

(10) Patent No.: US 6,591,774 B2
(45) Date of Patent: Jul. 15, 2003

(54) APPARATUS AND METHOD FOR PROTECTING SHIPS AND HARBORS FROM ATTACK BY VESSELS

(76) Inventors: Mark B. Metherell, 543 Brook St., Laguna Beach, CA (US) 92651; Alexander F. Metherell, 90 Emerald Bay, Laguna Beach, CA (US) 92651

( * ) Notice: Subject to any disclaimer, the term of this patent is extended or adjusted under 35 U.S.C. 154(b) by 0 days.

(21) Appl. No.: 10/155,463

(22) Filed: May 23, 2002

(65) Prior Publication Data

US 2003/0051652 A1 Mar. 20, 2003

Related U.S. Application Data

(60) Provisional application No. 60/293,399, filed on May 24, 2001.

(51) Int. Cl.[7] ..... B63G 9/00
(52) U.S. Cl. ..... 114/241; 114/240 E
(58) Field of Search ..... 114/10–14, 240 R, 114/240 A, 240 C, 240 D, 240 E, 241

(56) References Cited

U.S. PATENT DOCUMENTS 1,151,607 A * 8/1915 Newhall et al. ..... 114/241
1,299,026 A * 4/1919 Pugliese ..... 114/12
2,369,464 A 2/1945 Kalnitz
4,625,668 A 12/1986 Fitch
4,961,393 A 10/1990 Murray

FOREIGN PATENT DOCUMENTS

JP 20010406 4/2002
JP 2001091194 A 4/2002

* cited by examiner

*Primary Examiner*—Jesus D. Sotelo
(74) *Attorney, Agent, or Firm*—Orrick, Herrington & Sutcliffe LLP

(57) ABSTRACT

There is disclosed herein apparatus and methods for protecting ships and harbors from attack from other vessels. A barrier, fence or obstruction is constructed around the ship or harbor to be defended, either floating on the surface above and/or beneath the surface of the water. When a boat attempts to force its way through the barrier, the barrier uses the momentum of the vessel against itself by using the forward momentum of the attacking vessel in such a manner as to divert, impede, stop, damage or destroy the vessel or mitigate a blast from a vessel. The barrier may be active or passive. Also, a constructed wall of water can be provided to stop, destroy or disable a vessel attempting to go through the wall.

17 Claims, 13 Drawing Sheets

24
25
28
31
21
23
23

APPARATUS AND METHOD FOR PROTECTING SHIPS AND HARBORS FROM ATTACK BY VESSELS

This application claims benefit of 60/293,399 filed May 24, 2001.

The present invention relates to protection of ships and harbors from attack from other vessels.

BACKGROUND OF THE INVENTION

During peacetime, ships such as Naval assets, have been vulnerable to attack from small, fast vessels when the ships are in port. The USS Cole was vulnerable because the ship's captain could not differentiate between boats that were authorized to come along side and the terrorist vessel that exploded beside it.

Because of the USS Cole incident in Yemen and the threat of terrorism against naval assets, the Navy is searching for a viable solution to its problem. In the past, the Navy has tried to protect its assets by putting out buoys, logs, fenders or oil booms in the hopes of stopping these craft by creating a wall that would stop penetration into restricted areas. They have placed guard boats in the water to intercept approaching craft. In wartime, they have mined harbors in order to secure their vessels, but there is no system designed specifically to stop small boats from entering restricted areas.

Thus, a need still exists for a light weight, easily deployable barrier system for protecting a vessel.

There are several difficulties to overcome when designing such a barrier. The barrier itself must be portable so that it can be deployed from a ship when it is needed. It must be able to stop a vessel weighing 20,000 pounds moving at 80 feet per second. It must also be able to withstand the rigors of an ocean environment, such as strong tidal currents and swells.

SUMMARY OF THE INVENTION

The present invention overcomes the difficulties discussed by using the ocean and the force of the vessel itself to stop, destroy or inhibit the forward movement of the craft. The present invention may use the force of the attacking vessel and the ocean itself in a variety of different ways.

An embodiment of the invention uses a barrier that may capture the bow of the attacking vessel as it comes in contact with the barrier using a fence, net, cable or other device that is itself attached beneath the surface to an anchor, auger, sea anchor or like device. As the vessel continues forward, the fence, net or cable is pulled taut and the forward momentum of the vessel is translated down onto the bow. Once the bow is underwater, the center of gravity of the vessel will be higher than the bow, causing severe drag on the bow, plunging the bow deeper below the surface. If the vessel has enough velocity, the stern of the vessel will rotate around the submerged bow, then the stern will flip over the bow, capsizing and destroying the vessel. If the vessel does not have enough velocity to capsize, the majority of its force will be spent on the ocean as the bow drives in, stopping it.

In another embodiment, the invention may, in a sense, use the ocean itself as a barrier by bringing the ocean up into a wall of water that can stop, destroy or otherwise arrest the attacking vessel. A container, either flexible or inflexible in nature, is filled with sea water and supported above the surface by containers filled with air or other flotation type material below the surface that more than equal the volume of water above the surface. This not only serves as a barrier but also serves as a blast protection, to mitigate the effects of an explosive device.

Accordingly, it is a principal object of the present invention to provide an improved apparatus for protecting ships and harbors.

Another object of the present invention is to provide an improved method for protecting ships and harbors.

BRIEF DESCRIPTION OF THE DRAWINGS

These and other objects and features of the invention will become better understood through a consideration of the following description taken in conjunction with the drawings in which.

DETAILED DESCRIPTION

Turning now to the drawings, and first to FIGS. 1 through 8, embodiments of the present invention will be discussed. FIGS. 1 through 4 illustrate the underlying concept of apparatus and methods according to the present invention, as do FIGS. 5 through 8, with regard to the effect of applying a downward and/or downward and lateral force to the bow of an approaching vessel. Subsequent figures illustrate apparatus, devices and methods for accomplishing the application of the force to the bow of the approaching vessel.

Figure 1:
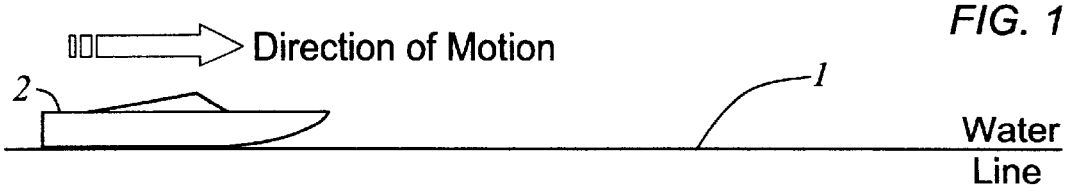
FIGS. 1 through 8 illustrate the effect of applying a downward force, and a downward and lateral force, on the bow of a vessel, to help explain the theory of the present concepts.
Figure 2:
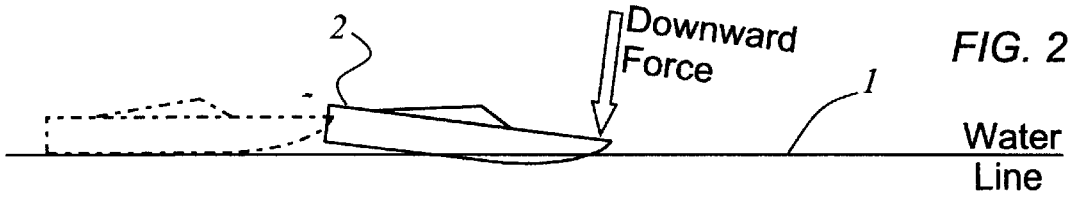
Figure 3:
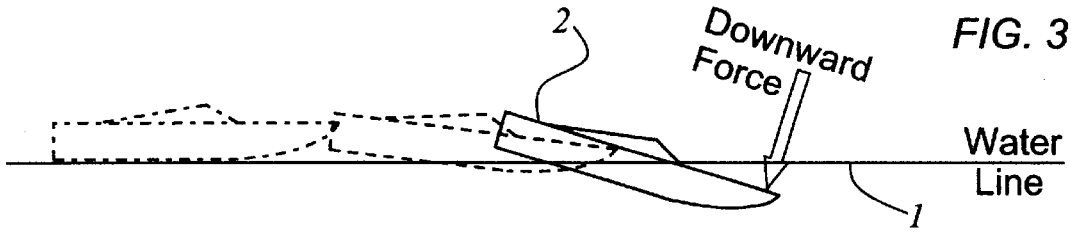
Figure 4:
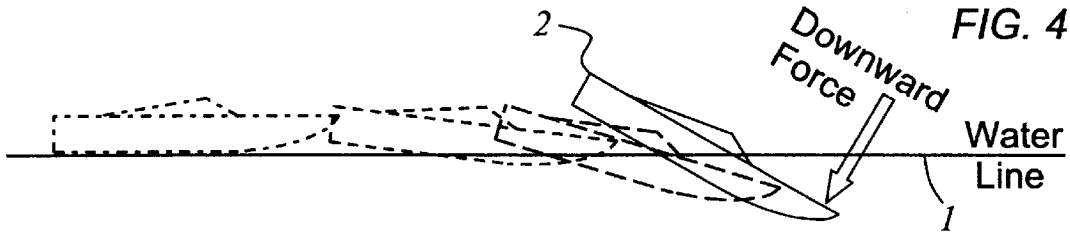
Figure 5:
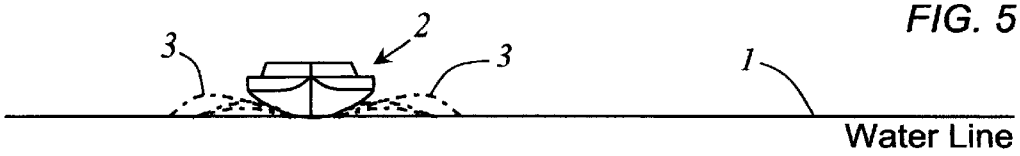

Thus, as seen in FIGS. 1 through 4 a waterline 1 depicts the surface of the water, and a boat or vessel 2 is shown moving in a direction from left to right in FIGS. 1 through 4. FIG. 2 illustrates the commencement of a downward force on the bow, and FIGS. 3 and 4 illustrate the effect of a continuation of this downward force. As will be appreciated from the illustrations in FIGS. 1 through 4, the continued application of the downward force causes the bow of the vessel to be pulled under water, and if the forward momentum of the vessel 2 is great enough, the vessel ultimately will capsize or at least the bow will go down into the water and be arrested prior to contact with a ship (to the right, not shown) to be protected.

Figure 6:
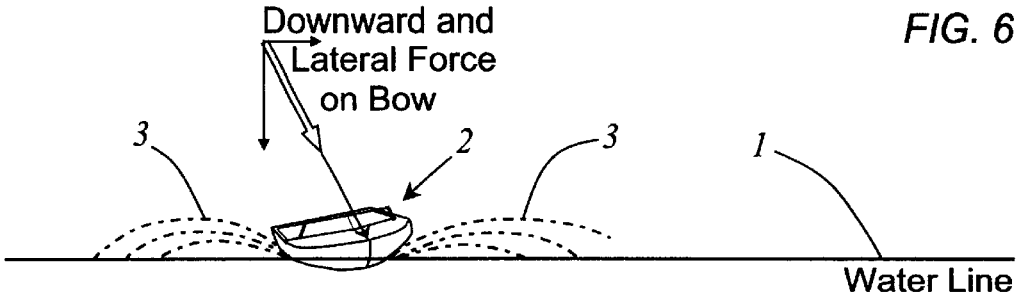
Figure 7:
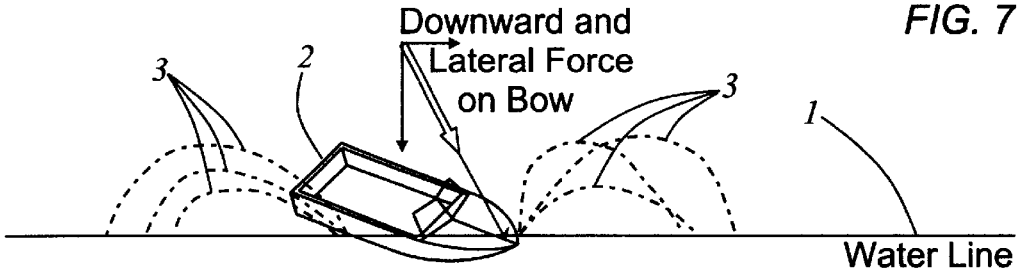
Figure 8:
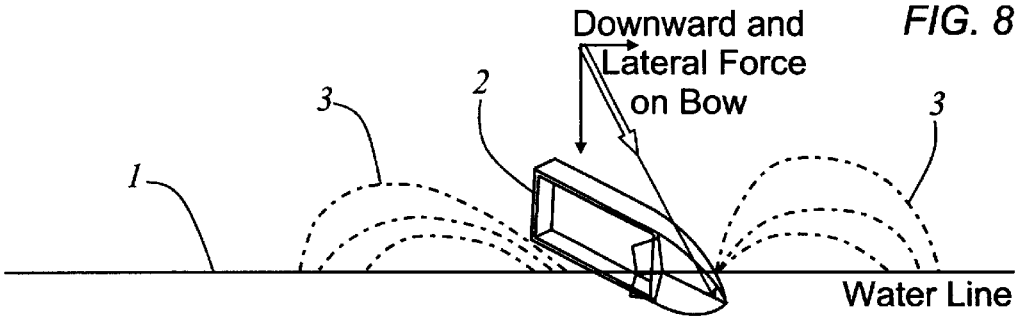

FIGS. 5 through 8 provide a similar illustration as in FIGS. 1 through 4, but include the application not only of a downward force, but also a lateral force on the bow. Here the boat 2 is proceeding along the surface of the water 1, and a wake or spray 3 is thrown up by the motion of the boat. In addition to the bow being moved downwardly into the water 2, the application of the lateral force will rotate the boat about its longitudinal axis, clockwise as illustrated in FIGS. 6–8.

Figure 9A:
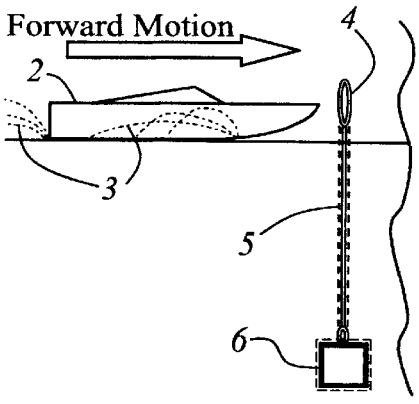
FIGS. 9*a* and 9*b* illustrate a simplified apparatus for creating a downward force on the bow.
Figure 9B:
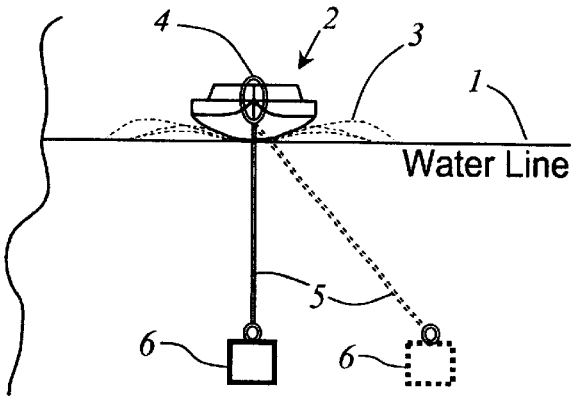
Figure 10:
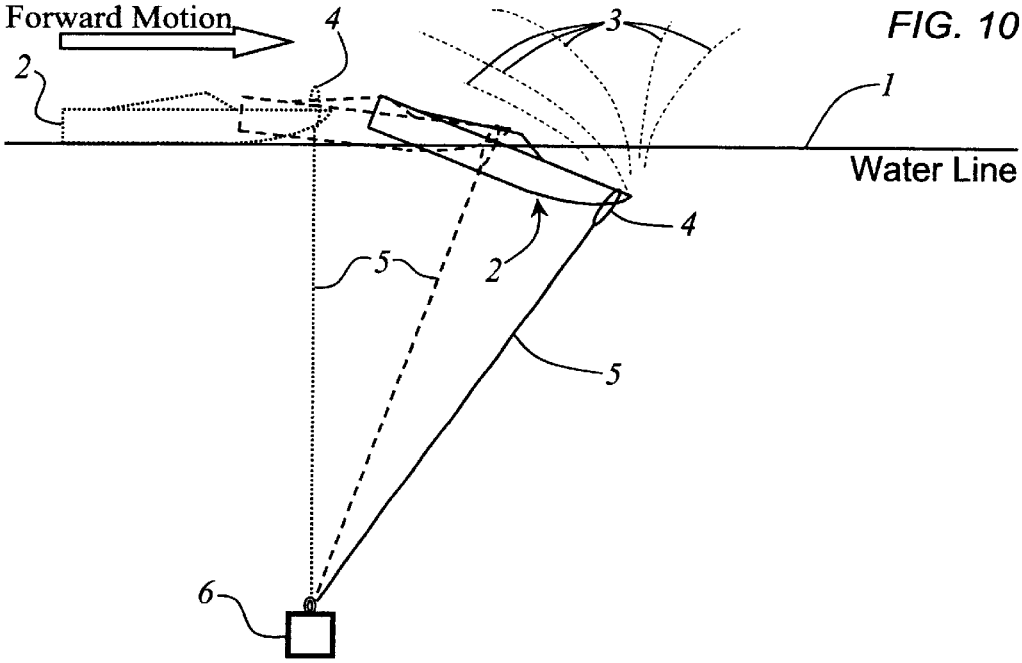
FIG. 10 shows the effect thereof.

With the foregoing in mind, we now turn to practical apparatus and methods for accomplishing the application of the desired force on the bow of the approaching vessel. FIGS. 9*a,* 9*b* and 10 are simplified diagrams of a capture device or snare 4 to capture the bow of the oncoming vessel 2. An anchor line 5 connects the capture device 4 to an anchor 6. The anchor may be a large heavy object on or above the sea bed, a conventional sea anchor on the sea bed, a "mud sucker" anchor (e.g., inverted saucer metal shaped metal plate on the sea bed), a sea anchor comprising a parachute device weighted down to hang freely from the bottom of the anchor line 5, or the like. The sea anchor may hang freely or, in a preferred embodiment, be stowed in a flexible or rigid deployment bag or casing. As illustrated in these simple views, the bow of the boat 2 engages the capture device 4, and as the boat 2 continues to move forward (to the right as shown in FIG. 10) the bow of the boat 2 is caused to move down into the water much like as illustrated in FIGS. 2–3 as previously discussed.

Figure 11:
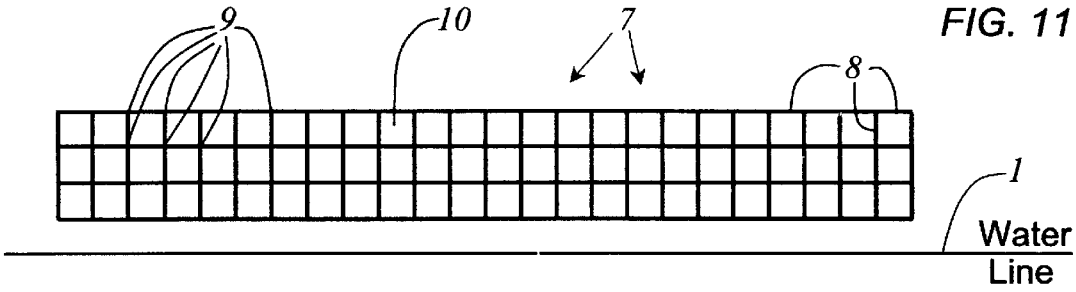
FIGS. 11 through 13 illustrate a capture device in the form of a fence and a buoying and anchoring system therefor.
Figure 12:
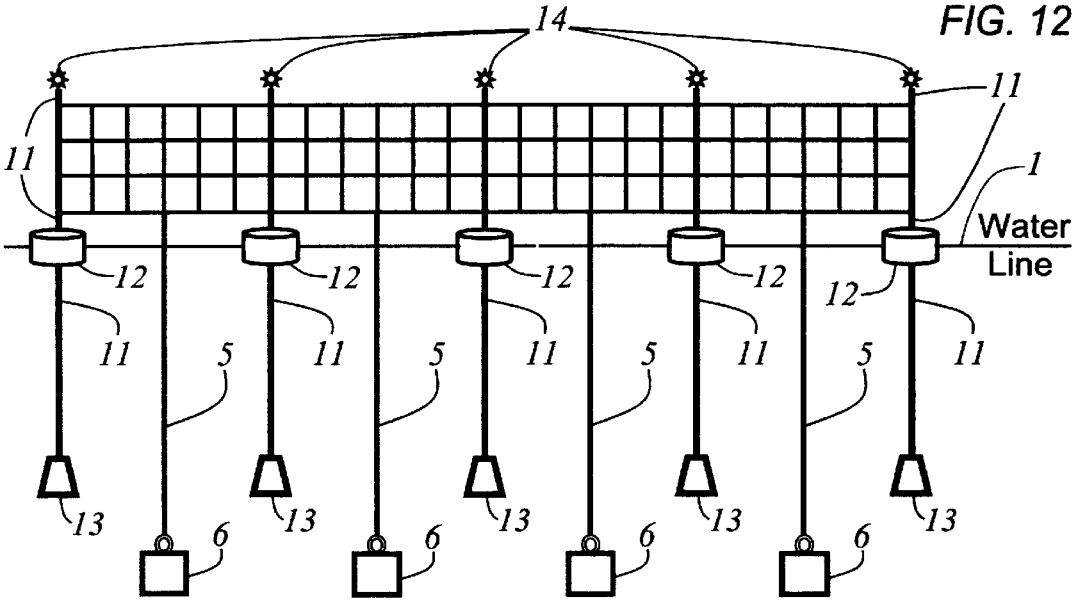
Figure 13:
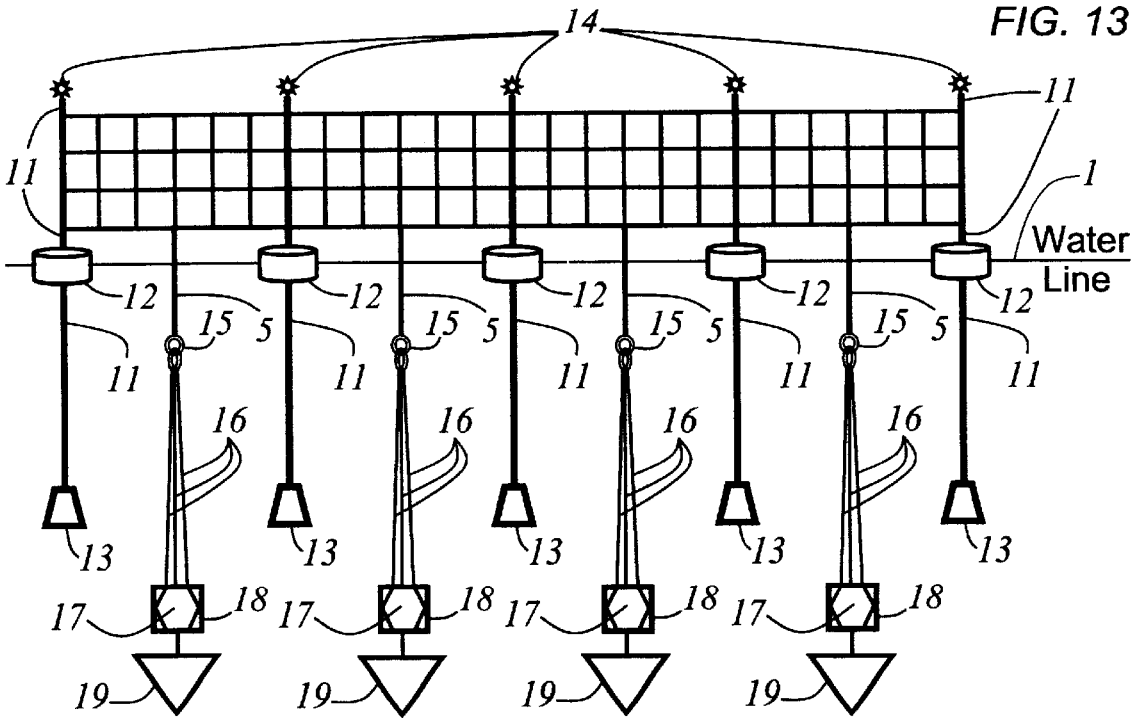

FIGS. 11 through 13 illustrate exemplary embodiments of a capture device which can be made wide enough to protect the side of a ship. In this embodiment a preferred capture device 7 comprises a net made of strong rope or cable 8 which is suspended above the water surface 1. The net 7 can be made of nylon or polymer rope, steel cable, or a sheet of strong material such as nylon, Mylar, canvas, Kevlar or the like. The top of the net is high enough, and the bottom is low enough, to capture the bow of the vessel 2. The rope 8 of the net may run horizontally and vertically to form a square pattern as shown, or diagonally to form a diamond, or a combination of horizontal, vertical and diagonal. Preferably, the rope or cable is knotted as seen at 9 or otherwise secured with a cross to form the net 7 with open cells 10. The ropes and knots are of sufficient strength for the forces to be transmitted to the bow of the vessel 2 onto the anchor 6 via line 5. The open cells that act as a capture device or snare in the net are large enough to capture the bow of the colliding vessel, but small enough to not allow the cell to pass too far down the hull of the vessel or to allow the vessel to pass through the net. An example cell size is 30 inches by 30 inches.

The net 7 is held in position by poles or masts 11 extending up from buoys 12 as seen in FIG. 12. Buoys 12 float on the water surface 1 and support the masts 11. Each mast 11 extends below the surface 1 of the water and is connected to a ballast weight 13 is optional and that holds the mast 11 upright in a vertical position. The ballast weight 13 is optional and if needed is provided to keep the pole 11 and buoy 12 system upright in rough sea and weather conditions. Light and/or reflector and/or radar reflectors 14 can be provided on the top of the poles 11 to make the position of the net 7 barrier system visible to approaching vessels.

Figure 14:
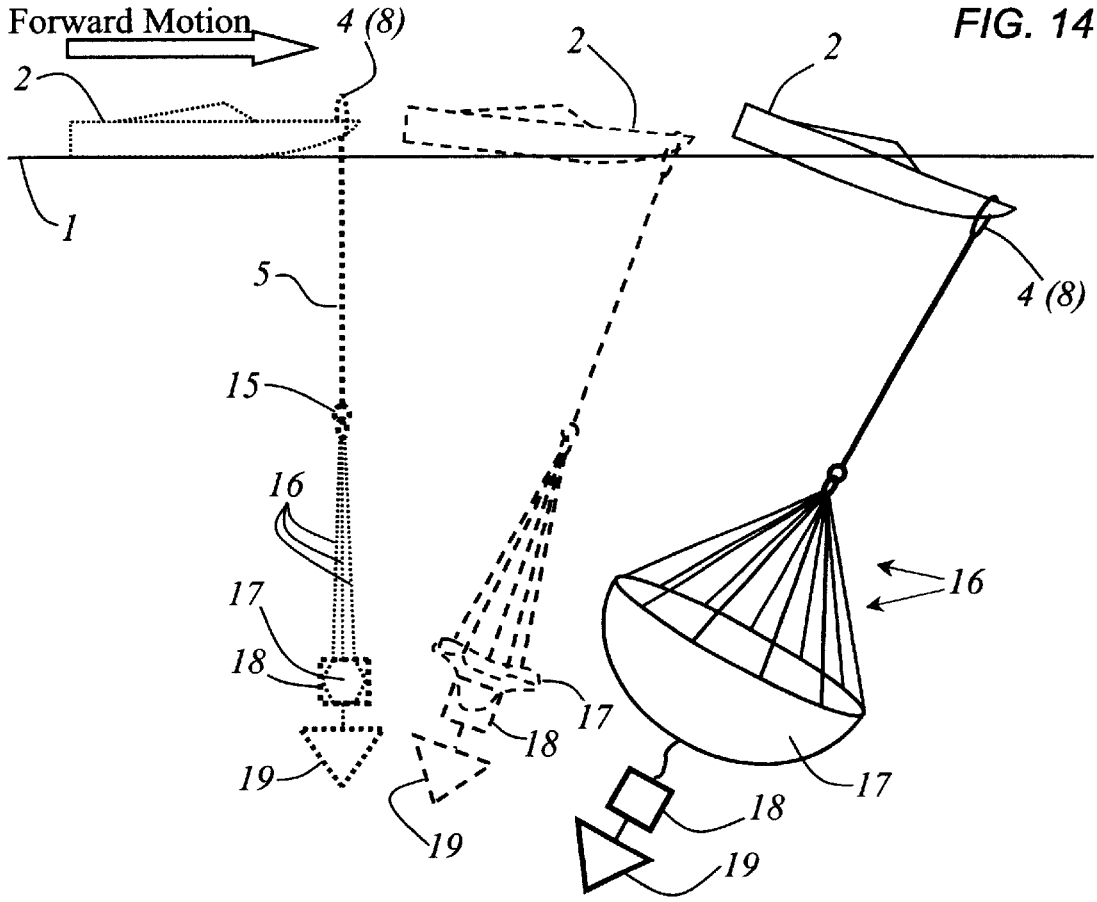
FIG. 14 illustrates an alternative deplorable sea anchor.

A further alternative is illustrated in FIG. 13 wherein gimbles connect the anchor lines 5 to sea anchor shroud lines 16 so as to allow the shroud lines to rotate to prevent them from becoming twisted. Thus, the deployable sea anchor shroud lines 16 connect the anchor lines 5 and connecting swivel and eye 15 to a sea anchor canopy 17 which preferably is packed in a deployment bag or container 18. A drogue cone or parachute 19 as seen in FIGS. 13 and 14 that will pull the deployment bag or container 18 off the sea anchor canopy 17 is provided so that the cone 19 will cause the canopy 17 to deploy when the anchor line 5 moves it through the water at a predetermined speed (e.g., above that of normal current and tidal action), as better seen in FIG. 14. FIG. 14 shows the action of the boat 2 moving forward catching a capture device 4 which in this embodiment is the rope 8 of the capture device 7 or fence. The continued motion as seen in FIG. 14 with the bow of the boat 2 pulling on the anchor line 5 deploys the sea anchor canopy 17 to apply the downward force to the bow of the boat 2 in the manner illustrated in FIG. 14 as well as in FIGS. 3 and 4.

When the vessel attempts to break through the net or fence it envelopes the bow of the vessel. The vessel continues into the barrier until the line is taut, at which point a downward force vector is applied to the bow of the vessel as illustrated in FIG. 2. The bow is pulled underwater and under the center of gravity of the vessel (FIG. 3) and if the forward momentum of the vessel is great enough, then the vessel will capsize (FIG. 4). If the momentum is small, then the bow will go down and the vessel will be arrested against the barrier.

If the cable to the anchor is not vertically positioned, but instead is positioned at an angle in the plane of the net (to get the vessel to roll, or an angle to the vertical if it is desired to cause the vessel to roll or be retarded further), then the downward force vector applied to the bow of the vessel will be downward and to the side as seen in FIGS. 6–8. This will cause the bow to both plunge downward and sideways causing the vessel to suddenly turn sideways (FIG. 7) while plunging which will cause the vessel to roll over violently (FIG. 8) rather than pitch the stern over the bow (pitch poling or pearling). In either event, the vessel will suffer severe damage and will be rendered useless. The angle can be both perpendicular to the plane of the net and/or in the plane of the net. For example: If the anchor is positioned below and in front of the net (so that the bow of the attacking vessel passes over the sea anchor before it makes contact with the net, the sea anchor will deploy faster because the anchor line is not vertical, but is angled in the direction of the motion of the attacking vessel. The angle of the anchor line can be off the vertical in any direction to produce different motions of the boat depending upon what we want the boat to do.

The use of a drogue or the like reduces the weight of the barrier. The sea anchor 17 is folded into the deployment bag 18 with the shroud lines 16 extending out of the bag 18. This causes the sea anchor 17 to deploy out of the bag 18 quickly (FIG. 14). The mouth of the sea anchor 17 can have bungee cords or some elastic device attached to it so that when there is no unnecessary tension on the shroud lines 16, the mouth closes and therefore will not be affected by the sea current. But when significant force is applied to the anchor by the attacking vessel snagging the fence, the mouth will open.

In a system that is used in a more permanent capacity, an anchor made of metal or other heavy strong material but shaped like a parachute, or a bell, can be used. This anchor uses not only its own weight but also the weight of the water in a concave bell (like a solid 17) in order to turn it into an incredibly heavy resistance. It can handle the effects of high stress loads, and long exposure to water without breaking. If the canopy is made of a rigid saucer shaped "canopy," such as steel for instance, then this would (1) add additional mass of the metal, and (2) already being in the "deployed" position would act quicker to apply a load to the anchor line 5.

The deployable fabric sea anchor also has an equivalent mass of water encompassed by the canopy of the sea anchor. This will need to be accelerated by the motion of the vessel. The total force applied to the anchor line 5 is a combination of the force necessary to accelerate this large mass of water plus the hydrodynamic drag of the sea anchor canopy.

To limit the load on the cable 5, so that the load will not exceed the breaking load of the cable, a portion of the cable may be wound onto a spool (not shown) that contains a brake which can be set on the cable to apply the wanted resistance so that the system will not break down if too much force is applied. If too much force is applied then the brake releases reducing the force to a manageable level. The incorporation of this spool and brake are optional to the main operation of the system.

A cable spool apparatus containing a spring mechanism attached at some point along the cable may be used if needed to keep the fence straight as the tide rises and falls. The apparatus can contain a brake that will lock the cable when the cable is suddenly pulled out above a certain speed. The spooling apparatus described above may be incorporated in a single apparatus with one spool, or it may be incorporated in separate spool apparatus.

Another way to keep the anchor line at ninety degrees to the surface in the rising and falling tides is to add a winch system on the surface or underwater that pulls in or lets out cable depending on the tide. The winch can be worked manually or it can be pre-programmed or radio controlled.

Figure 15:
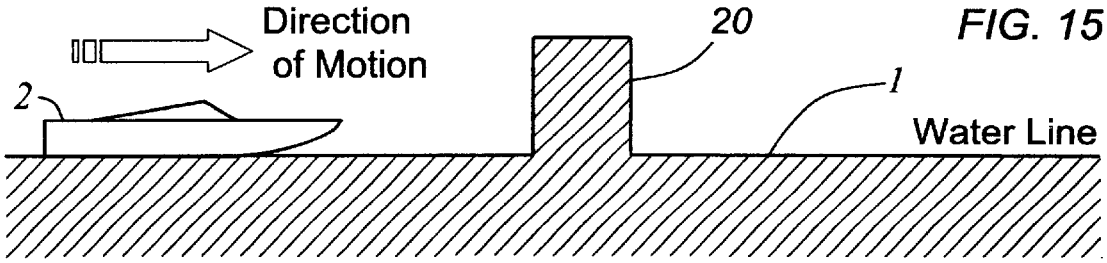
FIG. 15 is a diagrammatic illustration of a vertical "wall of water" disposed in the path of an approaching vessel to illustrate the theory of a further concept.

In another embodiment, the present invention as will be described below in connection with FIGS. 15–25, may comprise a vertical "wall of water" 20 erected of sufficient thickness and height above and possibly below the water surface to stop, destroy or disable a vessel attempting to go through the wall—see FIG. 15. The wall of water 20 above the surface 1 is contained in a structure resembling a water tank with one or more compartments. The wall of the water compartments may be flat or curved. The walls may be made of solid, relatively stiff material, or may be made of flexible sheet material such as rubberized material, canvas, Mylar, Kevlar or the like.

The wall of water is supported above the water surface by a buoyancy system that is constructed so that the wall will be stable under windy conditions or in ocean swells. In order to hold the wall in place, the wall can be either anchored to the bottom, or tied along side the ship, pier or other structure that is to be protected.

Figure 16:
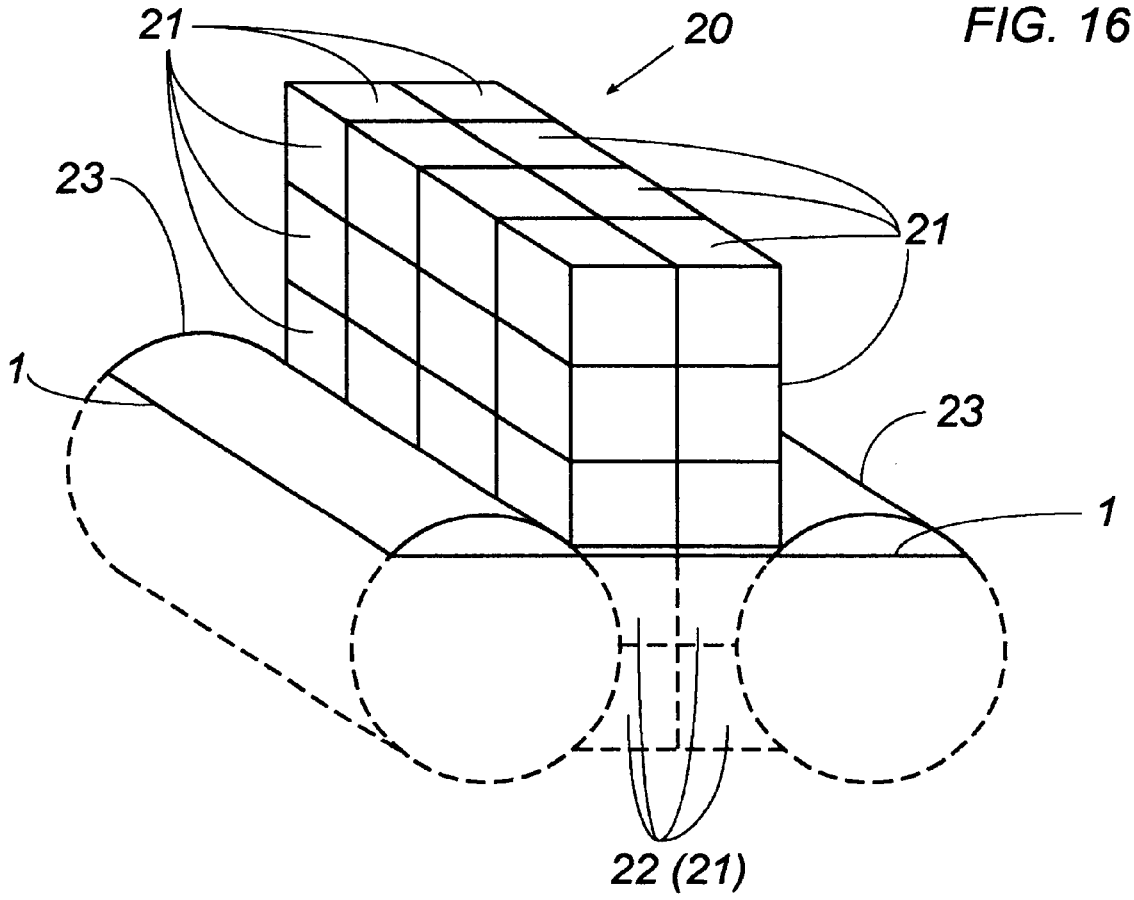
FIGS. 16 through 18 illustrate apparatus for providing a wall of water adjacent a ship to be protected.
Figure 17:
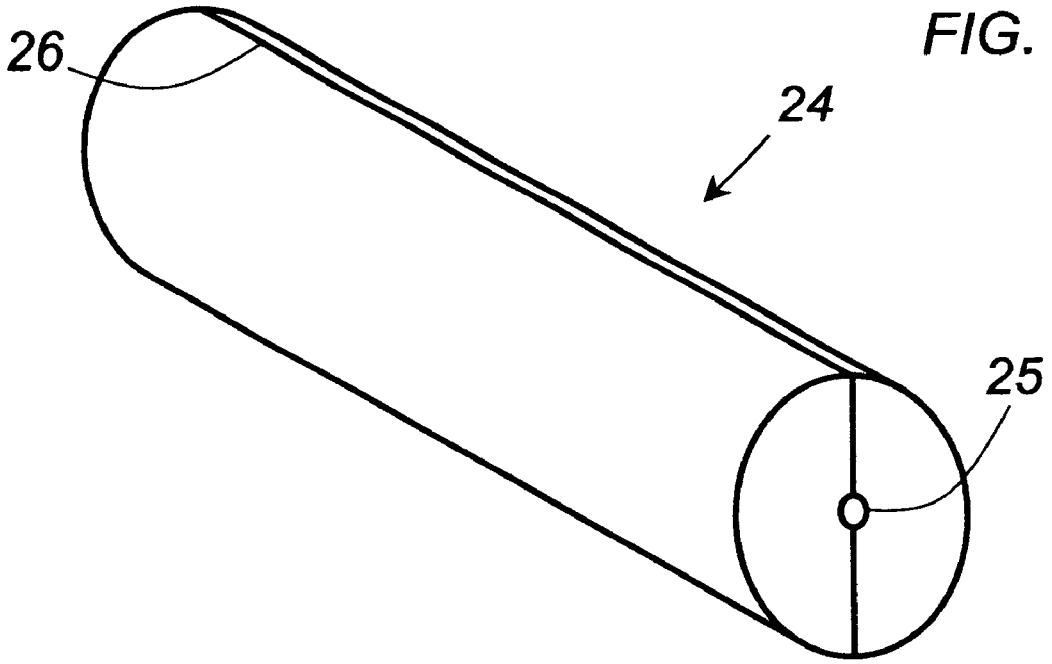
Figure 18:
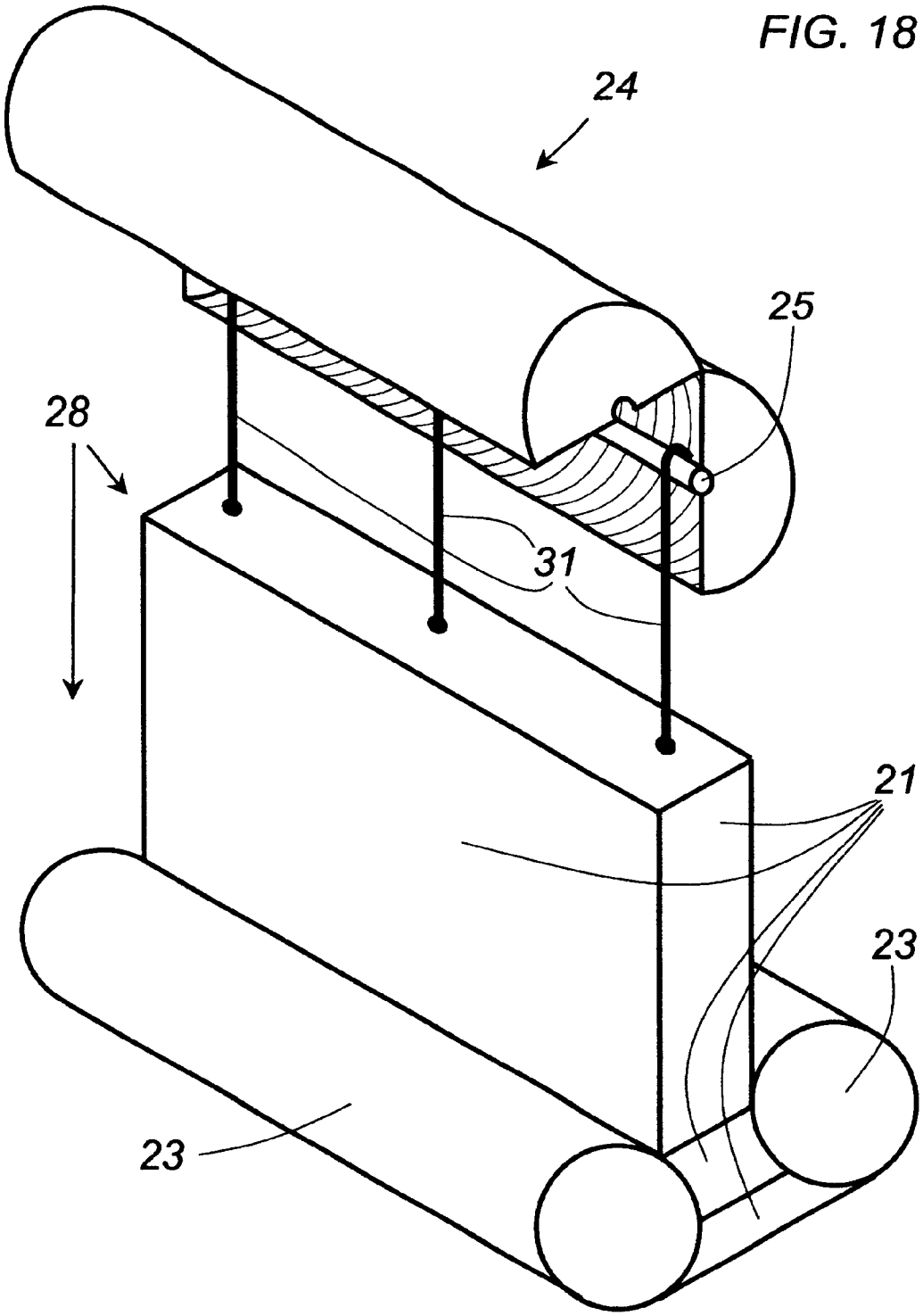

FIGS. 16 through 18 illustrate a manner in which the vertical wall of water can be provided, and FIGS. 19 through 23 show the deployment thereof. The wall of water 20 is formed or constructed through the use of sheets of reinforced plastic or fabric welded together to form compartments that can be filled with water at high pressure. The plastic or fabric is relatively inelastic so that when it is filled, the wall takes on a relatively rigid shape. The multiple small components are shown at 21 with welded plastic or fabric on all sides to increase the rigidity of the shape and provide strength to resist the water pressure inside. The compartments or cells 21 may be connected to each other with valves or ports in their internal walls so that the water can be pumped in from an external pump (not shown) and empties when the wall is deflated for storage. Preferably, the water wall includes compartments 22 below the water surface (sea level) which are neutrally buoyant and do not need significant support from flotation bags or chambers 23. The water filled compartments below the water line 1 keep air filled chambers 23 separated giving continuity of the water wall below the surface 1. The air filled compartments 23 provide the necessary buoyancy to support the weight of the water wall 20 that is above the water surface 1. Additional, optional, water filled compartments (not shown) can be attached just below the water surface 1 outboard of the air filled buoyancy compartments 23. These preferably are neutrally buoyant, but if the wall 20 tends to roll over it will be lifted up above the water line 1 causing the roll to correct itself, thus increasing the stability of the overall structure.

FIG. 17 illustrates a storage container 24 used to store the deflated sea wall made up of the compartments 21 which can be rolled up or folded when not in use. The purpose of the storage container 24 is to protect the sea wall components from inclement weather and heavy sea conditions when the ship or vessel carrying the water wall 20 system is under way. The storage container 24 has a tubular "clam shell" configuration, and has a spindle shaft 25 of a motorized winch system used to roll up the deflated sea wall compartments 21 and compartments 23 when they have been emptied of air and water. Other mechanisms can be used which can fold, rather than roll up, the deflated system. A longitudinal hinge 26 can be provided for the storage container 24 to allow the clam shell to open up to allow the deflated sea wall system to be lowered and deployed by unwinding it from the spindle or other stowing/packing device.

FIG. 18 illustrates the storage container 24 opened with the sea wall lowered from the winch spindle 25. The air filled buoyancy compartments 23, and resulting water filled sea wall system 28 formed of the compartments 21, are shown filled (which can be accomplished by suitable water and air hose lines, not shown). Winch cables 31 are provided for raising and lower the water wall system 28.

Figure 19:
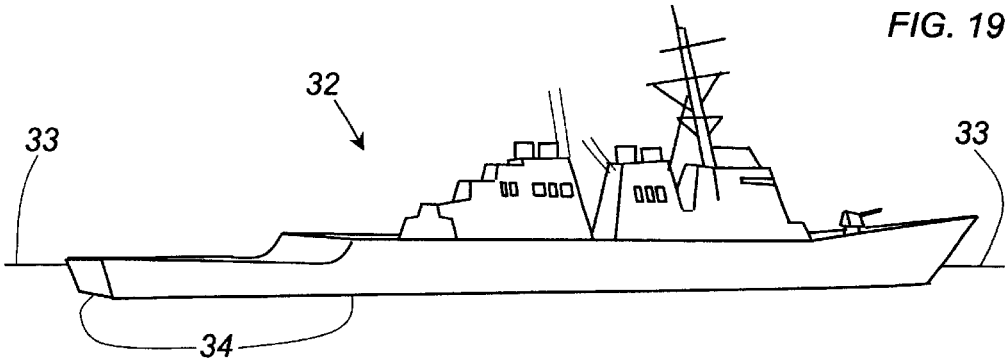
FIGS. 19 through 21 illustrate a ship and a deployment of apparatus for providing a wall of water.
Figure 20:
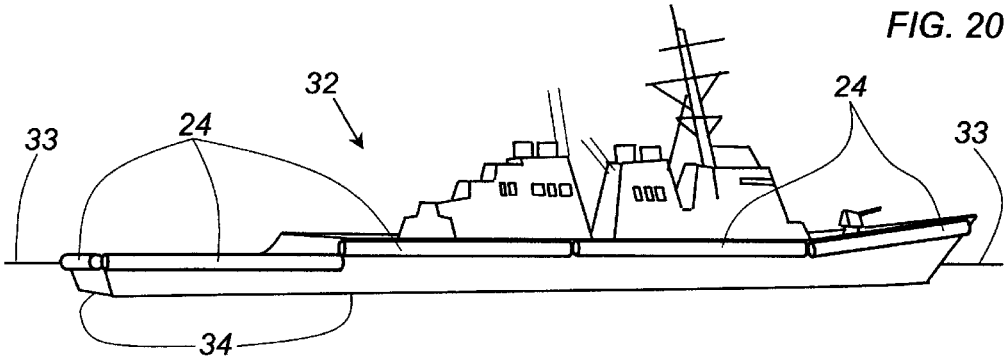
Figure 21:
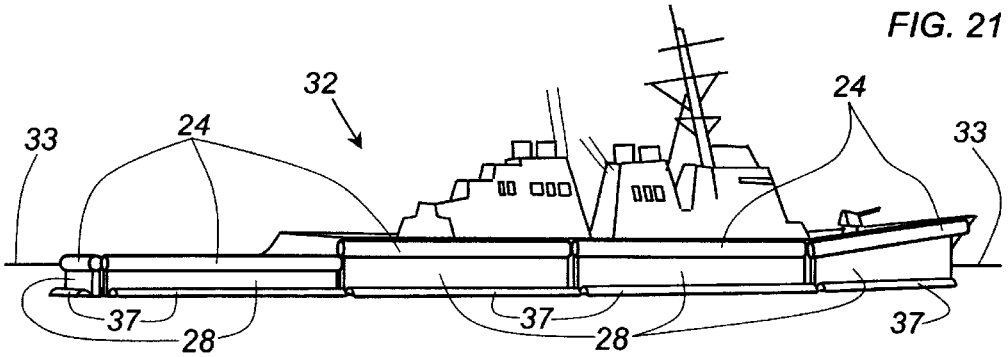
Figure 22:
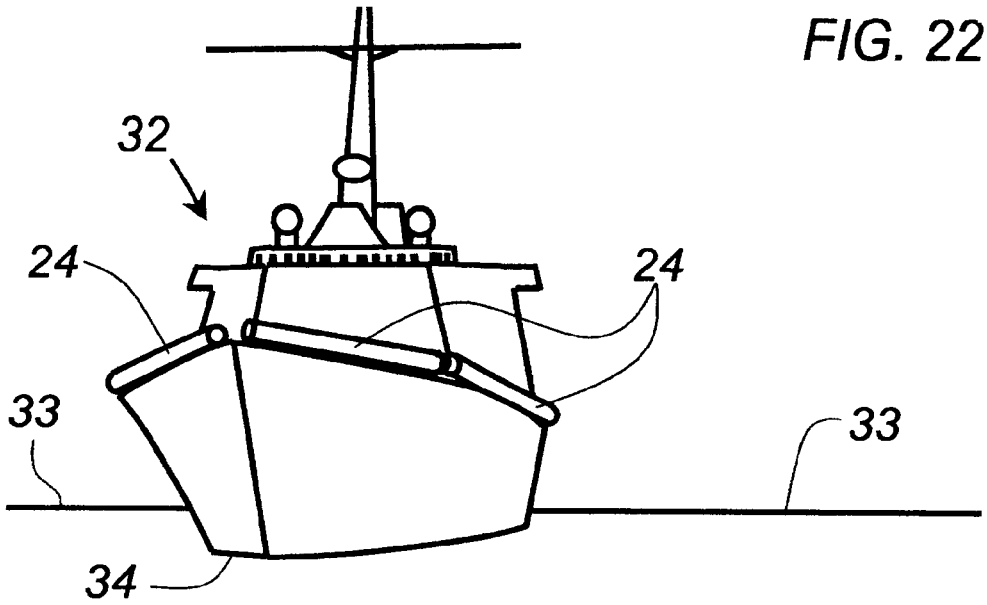
FIGS. 22 through 25 illustrate the effect of a deployed wall of water in protecting a ship from an adjacent vessel with explosives.

Turning now to FIGS. 19 through 21, a naval vessel 32 is illustrated in FIG. 19 without sea wall protection. FIG. 20 illustrates the vessel 32 with a sea wall stowed in storage canisters 24 mounted over the edges of the deck of the vessel 32. FIG. 21 illustrates the naval vessel 32 with the sea wall deployed (lowered from the storage canisters 24) providing a water wall apron surrounding the hull of the vessel. The horizon is indicated at 33, the water line on the ship's hull at 34, and with water filled compartments 28 deployed forming the water wall, and with air filled flotation compartments 23.

Figure 23:
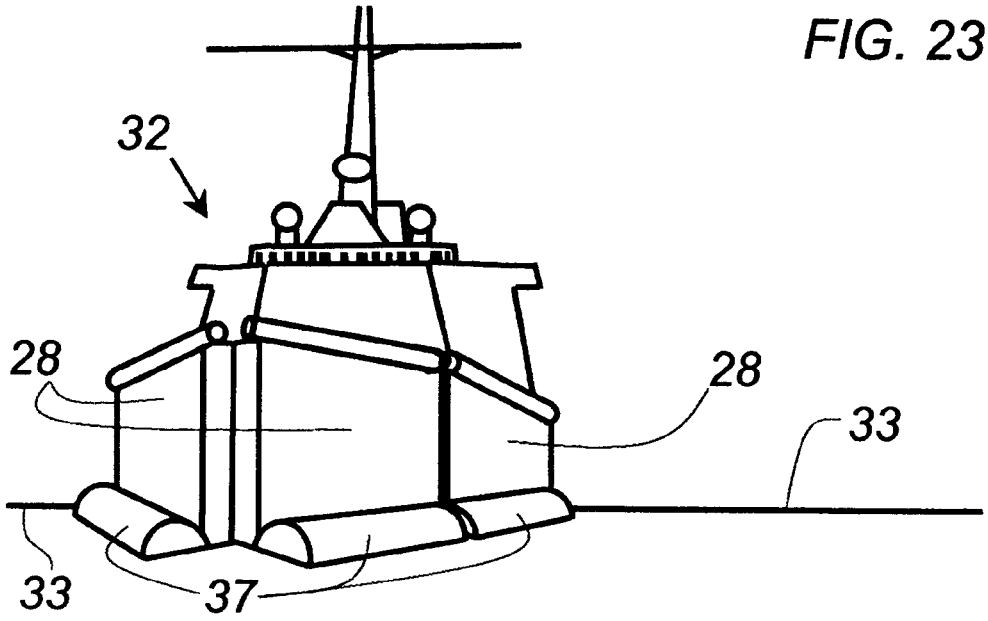
Figure 24:
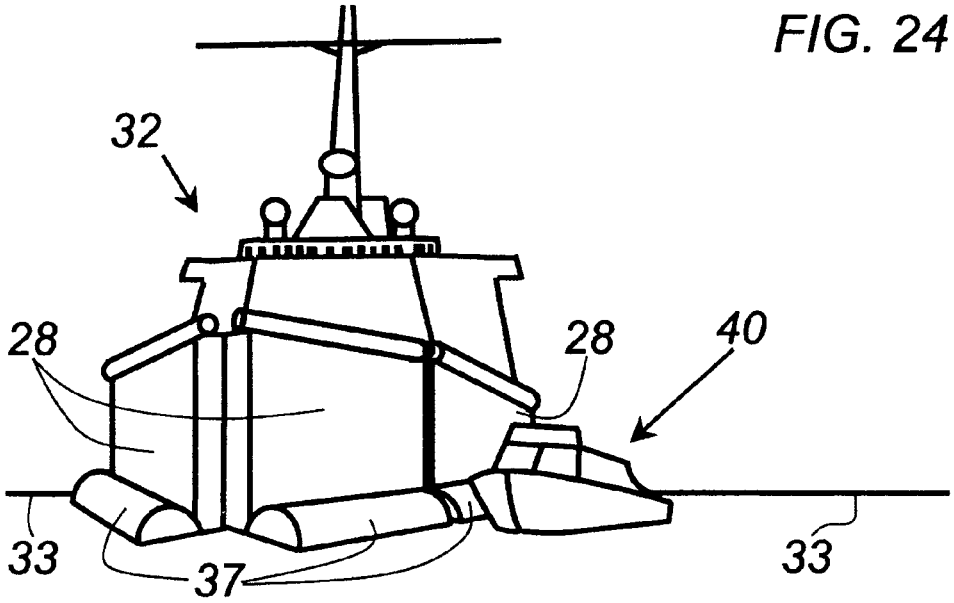
Figure 25:
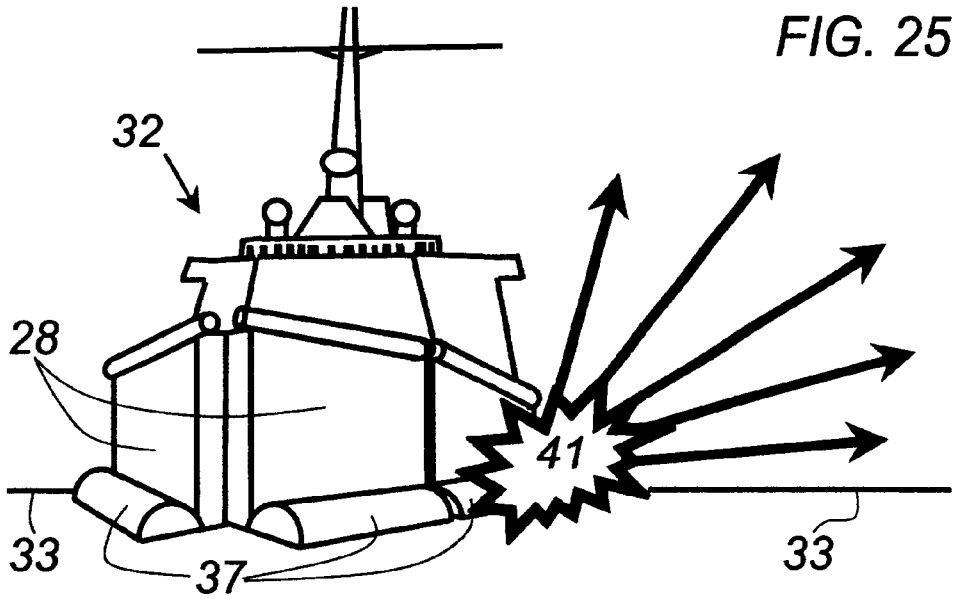

Turning now to FIGS. 22 through 25, FIG. 22 illustrates the vessel 32 with the sea wall stowed in storage containers 21 similar to the view of FIG. 20, and FIG. 23 shows the vessel 32 with the sea walls 36 deployed thereby providing an apron comprising a wall of water several feet thick surrounding the hull of the vessel 32. FIG. 24 further illustrates an explosive laden boat 40 alongside the vessel 32 with the sea wall 28 deployed. Finally, FIG. 25 illustrates explosives 41 detonating and the sea wall barrier 36 resisting the explosion thereby forcing most of the explosive power up and away from the naval vessel 32, greatly mitigating damage to the vessel.

It will be appreciated that the wall of water may be chambered with any suitable material in such a way so that if the wall is penetrated at a point, the water inside the wall will not totally drain out. The chambers may be flexible so that the other chambers in the wall will bulge and fill the gap left by the empty chamber. The chambers may be of any configuration, either longitudinally, laterally, honey-combed or the like. The chambers may be connected to one another. The material may be made of rubber, nylon, plastic, etc. A water pump is used to fill the chambers with sea water.

The individual chambers may have valves in them that allow water to escape when the pressure of the water at the time of impact threatens to rupture the chambers. Before the pressure threatens to rupture the chambers, the valves will allow the water to escape, thus lowering the pressure. The valves may be of any construction and may be placed on top or to the sides of the chambers. The chambers can also be opened to the air.

Not all the chambers need to be filled with water and can be filled with air in order to lighten the wall. Flexible air chambers in the wall itself may be filled first and then the wall filled with water. The hydrostatic pressure squeezes the air chambers at the bottom, allowing the volume of water to be greater at the bottom than at the top. This gives the wall more structural stability and makes the wall lighter, while keeping most of the water at the bottom to insulate the ship against attack by explosives or small boats.

The face of the wall that resists the attacking vessel may have a sheet or sheets of rigid material such as tough plastic, Kevlar or metal that allow the energy to dissipate over a larger area.

In order to support the wall, floatation devices filled with air, Styrofoam and the like can be placed and secured under and around the wall with a total displacement greater than the volume of the water in the wall above the surface. The wall can be placed at any distance from the ship that is being protected. If the apparatus is placed in direct contact with the hull, it acts as a blast protector that mitigates the explosive effect of any device, including improvised explosives, missiles, torpedoes and the like that are employed to destroy the ship.

In such applications, the apparatus of the present invention can extend below the water line, covering the ship's hull in order to protect the ship not only from surface craft but also from sub-surface attack. Underwater, the ship can have a water filled bladder sandwiched with air bladders. This reduces the effect of an explosion below the water line. This would extend from below the waterline to as high above the water line as deemed necessary to protect the ship. This would then present an air-water-air barrier "cocoon" that envelopes the hull of the protected ship above and below the water line.

By making this wall out of a thin, flexible material that can be inflated with air and filled with water, the system can be folded or rolled up so that it can be carried on the deck or attached to the railing of the ship when the ship is underway. It can be rolled up and stored in a tubular container as described earlier to protect it while the ship is underway. When the ship is pier-side the wall is filled and deployed in order to protect the ship from attack.

When the water wall system is deployed along the side of the ship, gangways can be deployed over the barrier and down to the water so that a tender vessel can be loaded and unloaded, all while protecting the ship against attack.

While embodiments of the present invention have been shown and described, various modifications may be made without departing from the scope of the present invention, and all such modifications and equivalents are intended to be covered.

What is claimed is:

1. Apparatus for protecting ships or harbors from attack by vessels comprising a capture device formed by a net of strong material to be disposed above a water surface, masts attached to the net for maintaining the net in an upright orientation, a plurality of buoys floatable on a water surface to which the masts are attached for supporting the respective masts, ballast weights adapted to be secured to lower ends of the respective masts, and anchors connected to sections of the net for providing a restraining force on the net against predetermined movement of the net.

2. An apparatus as in claim 1 wherein the anchors comprise deployable canopies which normally are packed in respective containers, but which canopies can be deployed as a result of force applied to the net by an attacking vessel.

3. An apparatus as in claim 2 wherein the canopies are connected via shroud lines and anchor lines to sections of the net, and the canopies normally are contained in respective containers comprising deployment bags.

4. An apparatus as in claim 1 wherein the anchors include canopies whereby a bow of a vessel engaging the net causes deployment of the canopy which in turn provides resistance to act as an anchor to impart a downward force to the bow of an attacking vessel.

5. An apparatus as in claim 1 wherein the anchors include canopies whereby a bow of a vessel engaging the net causes deployment of the canopy which in turn provides resistance to act as an anchor to impart a lateral force to the bow of an attacking vessel.

6. An apparatus as in claim 1 wherein the anchors include canopies whereby a bow of a vessel engaging the net causes deployment of the canopy which in turn provides resistance to act as an anchor to impart a downward and lateral force to the bow of an attacking vessel.

7. Apparatus for protecting ships or harbors from attack by vessels comprising a capture device formed by a net of strong material to be disposed above a water surface masts attached to the net for maintaining the net in an upright orientation, a plurality of buoys floatable on a water surface to which the masts are attached for supporting the respective masts, ballast weights adapted to be secured to lower ends of the respective masts, and anchors connected to sections of the net for providing a restraining force on the net against predetermined movement of the net whereby a bow of a vessel engaging the net causes the anchors to be pulled which in turn provides resistance to impart a downward force to the bow of an attacking vessel.

8. An apparatus as in claim 7 wherein the anchors comprise deployable canopies which normally are packed in respective deployment containers, but which canopies can be deployed as a result of force applied to the net by an attacking vessel.

9. An apparatus as in claim 8 wherein the canopies are connected via shroud lines and anchor lines to sections of the net, an the canopies normally are contained in respective deployment containers.

10. Apparatus for protecting ships or harbors from attack by vessels comprising a deployable "wall of water" comprising a plurality of water compartments forming a vertical structure comprising a sea wall for containing water to form a vertical wall of water, flotation chambers attached to the structure for retaining the structure in a vertical orientation, and the compartments of the structure and chambers are formed of resilient material allowing the same to be rolled or folded into a storage container for storing the sea wall when not in use and the container being attachable to the side of a ship or harbor to be protected.

11. Apparatus as in claim 10 wherein the sea wall is an elongated vertical structure which can be disposed alongside a ship or harbor to be protected from attack.

12. Apparatus as in claim 10 wherein the storage container includes a cable system for lowering the sea wall and flotation chambers downwardly therefrom, adjacent the side of a ship or harbor to be protected.

13. Apparatus as in claim 10 including a plurality of sea walls and flotation chambers attachable to and disposed around at least one longitudinal side of a ship or harbor to be protected.

14. A method for protecting ships or harbors from attack by vessels via a deployable "wall of water" comprising forming a vertical wall of water alongside a ship or harbor by providing water-filled resilient chambers secured together to form a vertical structure comprising a sea wall, and floating the sea wall adjacent a ship or harbor to be protected.

15. A method as in claim 14 comprising the further step of collapsing the structure to allow the same to be compactly disposed and attachable to the side of a ship or harbor to be protected.

16. A method as in claim 14 wherein the sea wall is provided to stop a vessel.

17. A method as in claim 14 wherein he sea wall is used for blast mitigation.

* * * * *